US008783851B2

(12) United States Patent
Suzuki et al.

(10) Patent No.: US 8,783,851 B2
(45) Date of Patent: Jul. 22, 2014

(54) PRINTING APPARATUS AND SHEET DRYING DEVICE

(75) Inventors: Yoshiaki Suzuki, Nagareyama (JP); Toshiaki Tokisawa, Kawasaki (JP); Kanto Kurasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 13/613,196

(22) Filed: Sep. 13, 2012

(65) Prior Publication Data

US 2013/0100217 A1 Apr. 25, 2013

(30) Foreign Application Priority Data

Oct. 21, 2011 (JP) ..... 2011-231637

(51) Int. Cl.
*B41J 2/01* (2006.01)
*B41J 11/00* (2006.01)

(52) U.S. Cl.
CPC ..... *B41J 11/002* (2013.01)
USPC ..... 347/102

(58) Field of Classification Search
None
See application file for complete search history.

(56) References Cited

U.S. PATENT DOCUMENTS

2010/0110156 A1* 5/2010 Hara et al. ..... 347/102

FOREIGN PATENT DOCUMENTS

JP 2003-215776 A 7/2003

* cited by examiner

*Primary Examiner* — Geoffrey Mruk
(74) *Attorney, Agent, or Firm* — Fitzpatrick, Cella, Harper & Scinto

(57) ABSTRACT

To downsize a drying device that blows gas on a sheet to dry the sheet, a printing apparatus that includes a print head of an inkjet type is provided with a drying unit that dries a sheet printed by a print head. The drying unit has a plurality of conveying rollers that support the sheet; a conveying belt that conveys the sheet; and a nozzle that is arranged between the plurality of conveying rollers in a direction of the conveyance of the sheet by the conveying belt and blows gas toward the sheet. The nozzle has a blowout port and the blowout port is tilted with respect to a surface of the sheet, which is supported by the conveying rollers.

10 Claims, 10 Drawing Sheets

PRINTING APPARATUS AND SHEET DRYING DEVICE

BACKGROUND OF THE INVENTION

1. Field of the Invention

The present invention relates to a printing apparatus that ejects ink droplets to perform printing and sheet drying device, and in particular, to a printing apparatus and sheet drying device that, in a conveyance process of a sheet, blow air on the sheet to perform drying.

2. Description of the Related Art

As a printing apparatus that ejects ink droplets from a print head onto a sheet to perform printing, there is an apparatus of a type having a drying device that blows air on a printed sheet to dry ink droplets placed on the sheet. As described, by blowing air on the printed sheet to perform drying, the ink droplets placed on the sheet can be more quickly fixed. The fixation of the ink droplets to the sheet can be quickly performed, and therefore quality of a printed image on the sheet can be prevented from being reduced by the contact of a printed surface of the sheet with a surround before the printed image is dried. Also, ink can be prevented from being attached to the surround to make the surround dirty by the contact of the sheet with the surround before the printed image is dried.

As a printing apparatus that blows air on a printed sheet to dry the sheet, and thereby more quickly fixes a printed image to the sheet as described, there is a printing apparatus disclosed in Japanese Patent Laid-Open No. 2003-215776. Japanese Patent Laid-Open No. 2003-215776 discloses the printing apparatus having a drying device in which dry air supplied from an air blower is blown on a sheet through an air duct formed with a number of nozzles. The dry air supplied from the air duct presses the sheet against a conveying belt, and also the dry air is blown on the sheet to thereby dry the sheet.

However, the drying device disclosed in Japanese Patent Laid-Open No. 2003-215776 is configured to press the sheet against the conveying belt with the dry air. Accordingly, the dry air is required to have a flow rate enough to support the sheet. To support the sheet, the dry air having such a large flow rate is uniformly supplied to the sheet, and therefore the air duct is required to have a space enough for the large flow rate dry air to circulate. For this reason, a large-sized air duct is required for the drying device, and thereby the drying device may be increased in size.

SUMMARY OF THE INVENTION

In view of the above-described circumstances, an object of the present invention is to downsize a drying device that blows gas on a sheet to dry the sheet.

According to an aspect of the present invention, there is provided a printing apparatus comprising: a print head of an inkjet type; and a drying device that dries a sheet printed by the print head, wherein the drying device includes: a plurality of support units configured to support the sheet; a conveyance unit configured to convey the sheet; and a blowout unit that is arranged between the plurality of support units in a direction of the conveyance of the sheet by the conveyance unit and configured to blow gas toward the sheet, wherein the blowout unit includes a blowout port and the blowout port is tilted with respect to a surface of the sheet being supported by the support units.

According to an aspect of the present invention, there is provided a sheet drying device for drying a sheet comprising: a plurality of support units configured to support the sheet; a conveyance unit configured to convey the sheet; and a blowout unit that is arranged between the plurality of support units in a direction of the conveyance of the sheet by the conveyance unit and configured to blow gas toward the sheet, wherein the blowout unit includes a blowout port and the blowout port is tilted with respect to a surface of the sheet being supported by the support units.

According to the present invention, the drying device can be downsized to realize a downsized printing apparatus and sheet drying device.

Further features of the present invention will become apparent from the following description of exemplary embodiments (with reference to the attached drawings).

DESCRIPTION OF THE EMBODIMENTS

Embodiments of the present invention will hereinafter be described with reference to the drawings.

First Embodiment

A printing apparatus 100 according to a first embodiment of the present invention is described. In the printing apparatus 100 of the present embodiment, as a sheet, a continuous sheet wound in a roll shape is used. The printing apparatus 100 of the present embodiment is used as a high-speed line printer that meets both of single-sided printing and double-sided printing. Such a printing apparatus 100 is suitable for use where, for example, printing on a large number of sheets is performed in a printing laboratory or the like.

Figure 1:
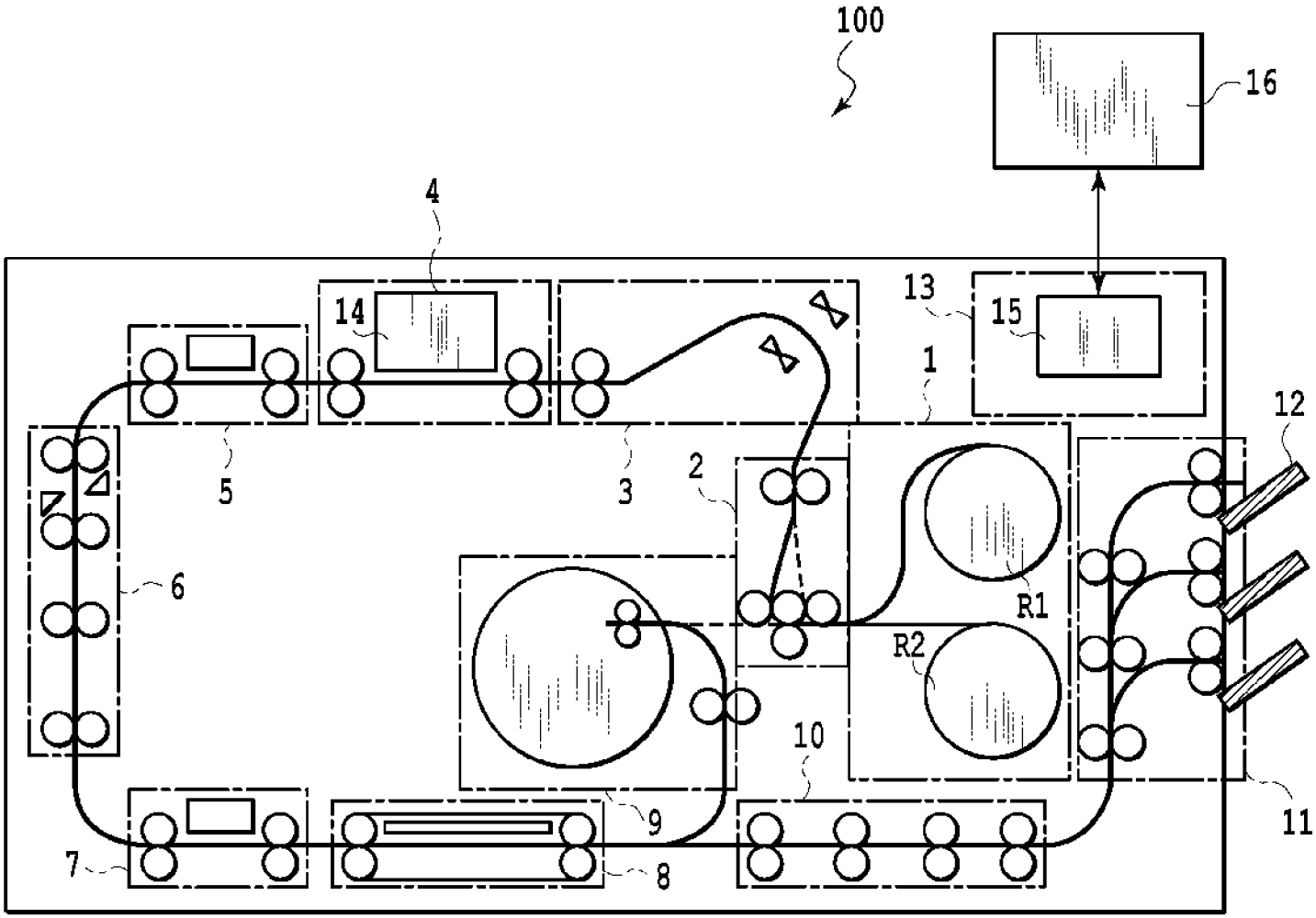
FIG. 1 is a schematic cross-sectional view illustrating an overall configuration of a printing apparatus according to a first embodiment of the present invention.

FIG. 1 is a schematic cross-sectional view illustrating an internal configuration of the printing apparatus 100. The printing apparatus 100 is roughly provided with respective units of a sheet feeding unit 1, decurling unit 2, skewing correcting unit 3, printing unit 4, inspecting unit 5, cutter unit 6, information printing unit 7, drying unit 8, sheet rewinding unit 9, discharge conveyance unit 10, sorter unit 11, discharge tray 12, and control unit 13. The sheet is conveyed by a conveyance mechanism including roller pairs and belts along a sheet conveyance path indicated by a solid line in the view, and subjected to respective processes by the respective unit.

The sheet feeding unit 1 is a unit that contains the continuous sheet wound in a roll shape to feed the continuous sheet. The sheet feeding unit 1 can contain two rolls R1 and R2. Of the two rolls R1 and R2, one end of any one is selectively extracted toward a downstream side of the conveyance path, and fed to the conveyance path as the sheet. Note that, in the present embodiment, the number of rolls capable of being contained in the sheet feeding unit 1 is two; however, the number of rolls capable of being contained is not limited to two, but may be one, or three or more. The decurling unit 2 is a unit that reduces a degree of curl (bend) of the sheet fed from the sheet feeding unit 1. In the decurling unit 2, two pinch rollers are used for one driving roller, and between the two pinch rollers and the driving roller, reverse bends are respectively provided. This causes the sheet to be reversely bent and drawn. This causes the degree of curl of the sheet to be reduced. The skewing correcting unit 3 is a unit that corrects skewing (skew with respect to an original traveling direction) of the sheet having passed through the decurling unit 2. By pressing an end part of the sheet on a reference side against a guide member, the skewing of the sheet is corrected.

Figure 4:
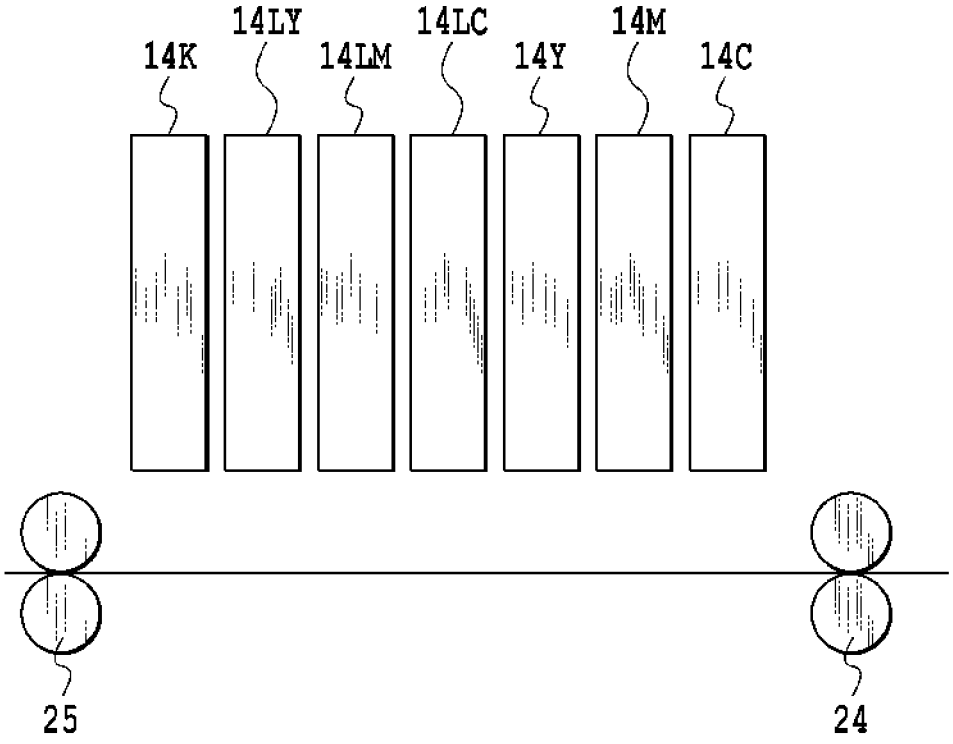
FIG. 4 is a side view schematically illustrating a printing unit of the printing apparatus in FIG. 1.

The printing unit 4 is a unit that forms an image on the conveyed sheet with a print head 14. As described, the printing apparatus of the present embodiment has the print head 14 that can eject ink droplets. The ink droplets are ejected from the print head 14 onto the sheet to perform printing on the sheet. The printing unit 4 is provided with a plurality of conveying rollers that convey the sheet. The print head 14 includes a line type print head that is formed with an ejection port array of an inkjet type to the extent that covers a maximum width of a sheet supposed to be used. As illustrated in FIG. 4, in the printing unit 4, a plurality of print heads 14 are parallel arranged along a conveying direction. In the present embodiment, the printing unit 4 has seven print heads respectively corresponding to seven colors of C (cyan), M (magenta), Y (yellow), LC (light cyan), LM (light magenta), G (gray), and K (black). Note that the number of colors and the number of print heads are not limited to seven. As the inkjet type, a type using a heating element, type using a piezo element, type using an electrostatic element, type using an MEMS element, or the like can be employed. Respective color inks are supplied from ink tanks to the print head 14 through ink tubes.

Figure 5:
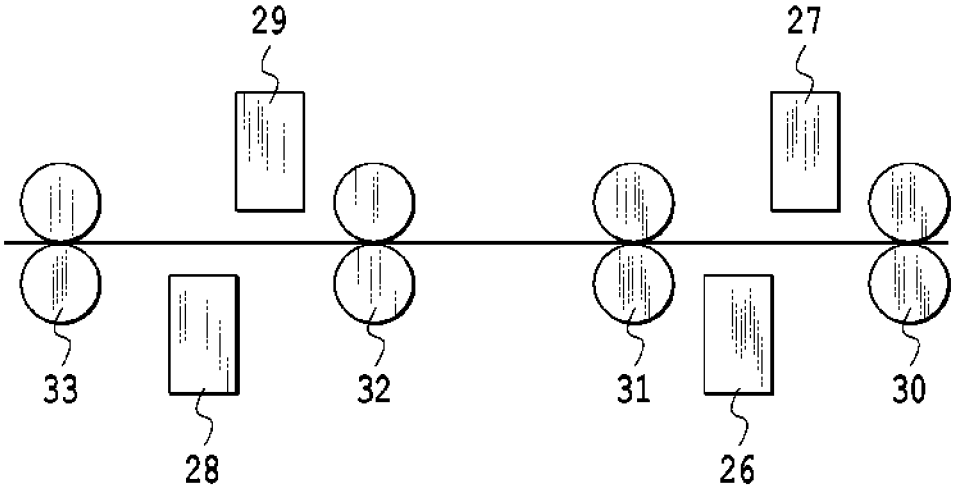
FIG. 5 is a side view schematically illustrating a cutter unit of the printing apparatus in FIG. 1.

The inspecting unit 5 is a unit that optically reads an inspection pattern or image printed on the sheet in the printing unit 4, and inspects states of ejection ports of the print head, sheet conveyance state, image position, and the like. As illustrated in FIG. 5, the cutter unit 6 is a unit that is provided with mechanical cutters 26, 27, 28, and 29 that cut the sheet after the printing to a predetermined length. Further, the cutter unit 6 is also provided with a plurality of conveying rollers 30, 31, 32, and 33 for sending the sheet to the next process. The information printing unit 7 is a unit that prints print information such as a serial number and date of the printing on a back surface of the sheet cut. The drying unit 8 is a unit that heats the sheet, which is printed in the printing unit 4, to dry provided inks in a short period of time. The drying unit 8 is also provided with a conveying belt and conveying rollers for sending the sheet to the next process.

The sheet rewinding unit 9 is a unit that temporarily rewinds the continuous sheet in which printing on a front surface for the case of the double-sided printing is completed. The sheet rewinding unit 9 is provided with a rewinding drum that rotates in order to rewind the sheet. The continuous sheet that has been printed on the front surface but is not yet cut is temporarily rewound by the rewinding drum. After completion of the rewinding, the rewinding drum reversely rotates to feed the rewound sheet to the decurling unit 2, and then sent to the printing unit 4. The sheet has been turned over, and therefore in the printing unit 4, printing on the back surface can be performed. More specific operation of the double-sided printing will be described later.

The discharge conveyance unit 10 is a unit that is intended to convey the sheet that has been cut in the cutter unit 6 and dried in the drying unit 8, and deliver the sheet to the sorter unit 11. The sorter unit 11 is a unit that discharges printed sheets with sorting the printed sheets into different trays of the discharge tray 12 on a group basis as needed. The control unit 13 is a unit that controls the respective units of the whole of the printing apparatus. The control unit 13 has a CPU, memory, controller 15 provided with various types of I/O interfaces, and power supply. Operation of the printing apparatus is controlled on the basis of instructions from the controller 15 or an external device 16, connected to the controller 15 through an I/O interface, such as a host computer.

Next, basic operation at the time of printing is described. Printing operation is different between the single-sided printing and the double-sided printing, and therefore each of them is described.

Figure 2:
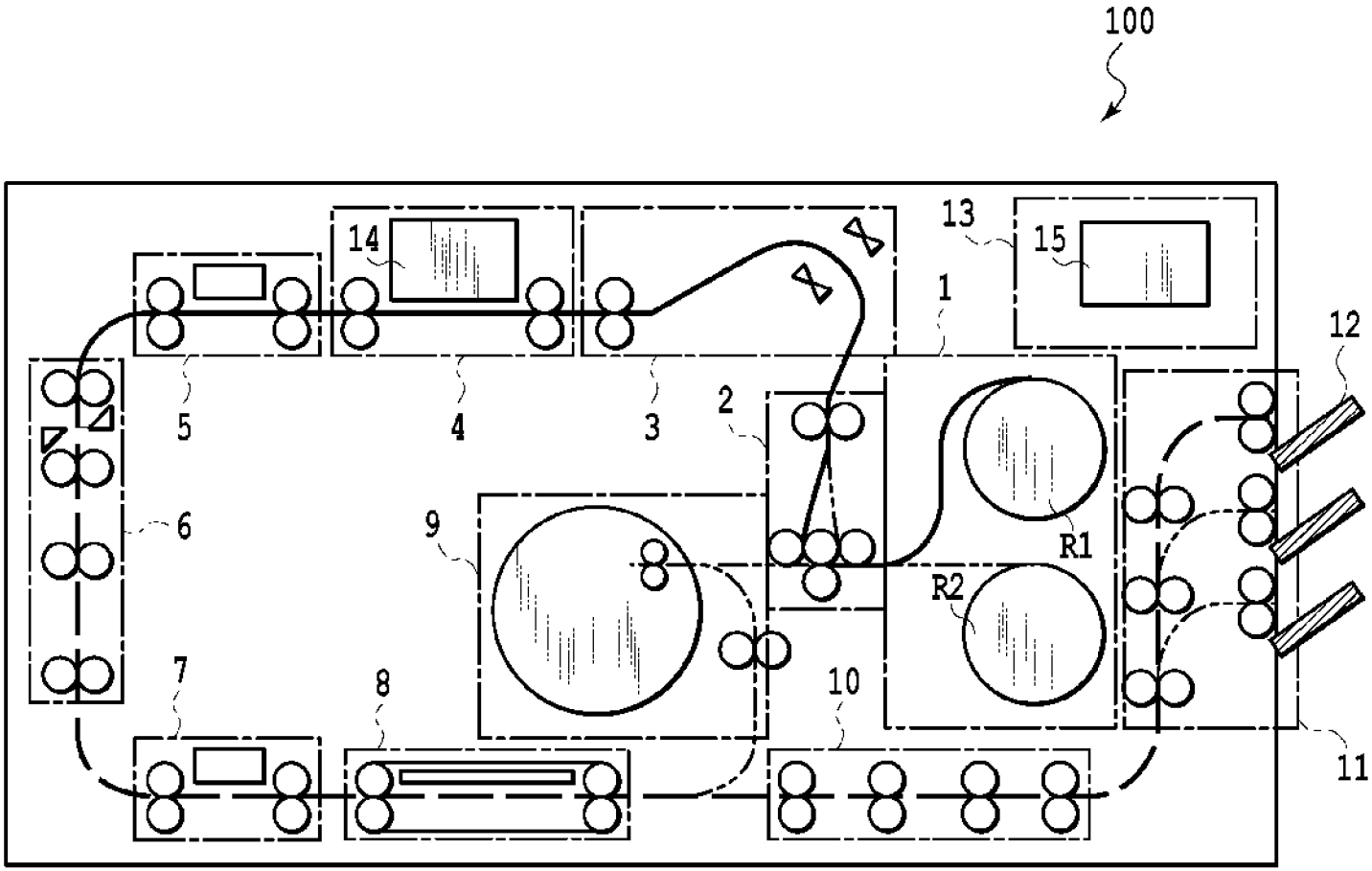
FIG. 2 is an explanatory diagram for explaining operation of the printing apparatus at the time when single-sided printing is performed by the printing apparatus in FIG. 1.

FIG. 2 is a diagram for explaining the operation of the printing apparatus 100 at the time of performing the single-sided printing. In FIG. 2, the sheet conveyance path from printing the sheet fed from the sheet feeding unit 1 to discharging the sheet to the discharge tray 12 is indicated by a thick line. The sheet that has been fed from the sheet feeding unit 1 and processed respectively in the decurling unit 2 and skewing correcting unit 3 is printed on the front surface thereof in the printing unit 4. The printed sheet passes through the inspecting unit 5, and is cut in the cutting unit 6 at intervals of a predetermined unit length that is preset. Each of the cut sheets is printed on a back surface thereof with print information in the information printing unit 7 as needed. Then, the cut sheets are conveyed to the drying unit 8 and dried one by one. After that, the cut sheets pass through the discharge conveyance unit 10, and sequentially discharged to and stacked on the tray 12 of the sorter unit 11.

Figure 3:
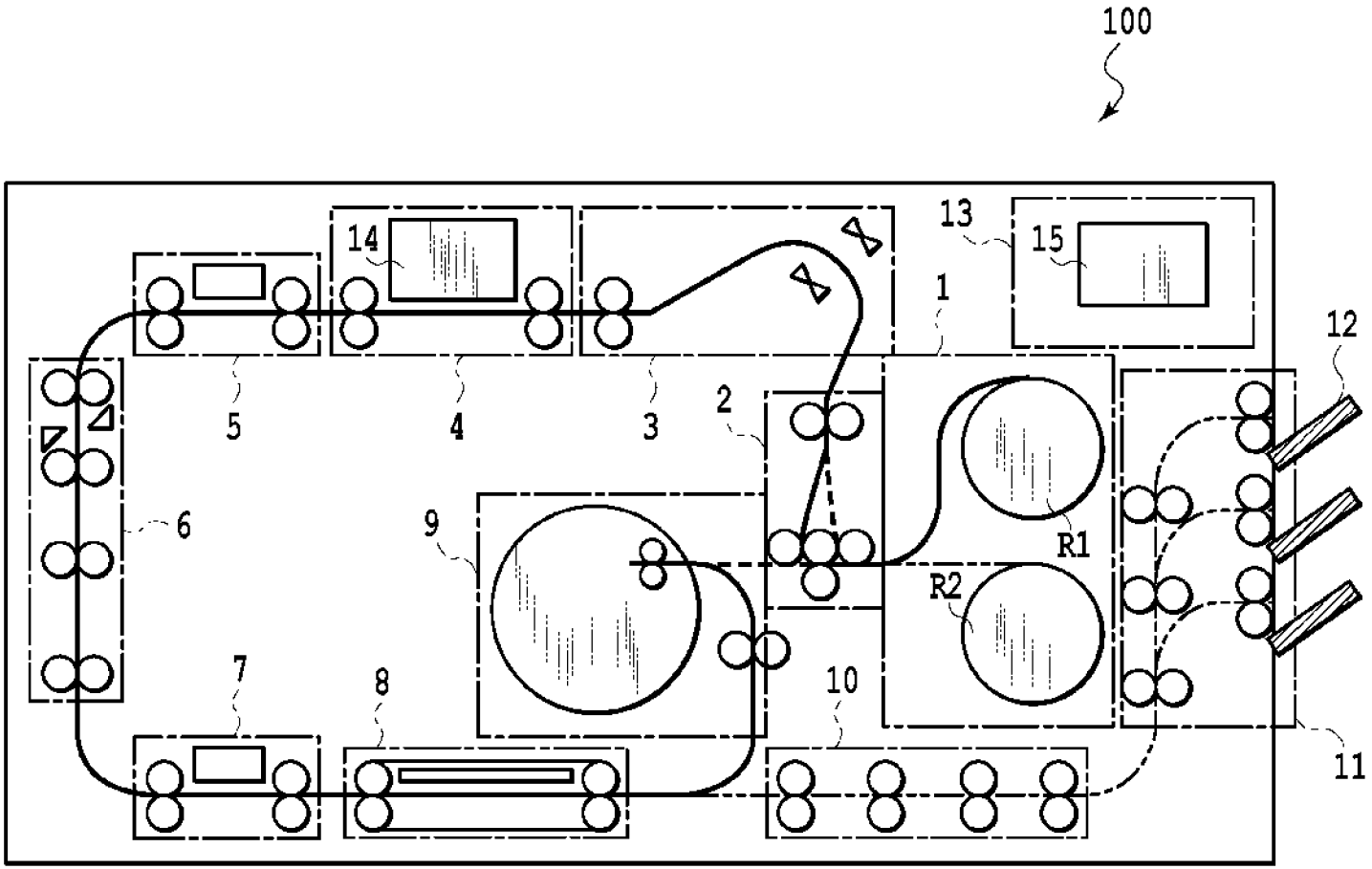
FIG. 3 is an explanatory diagram for explaining operation of the printing apparatus at the time when double-sided printing is performed by the printing apparatus in FIG. 1.

FIG. 3 is a diagram for explaining the operation of the printing apparatus 100 at the time of performing the double-sided printing. In the double-sided printing, subsequent to a sequence of front surface printing, a sequence of back surface printing is performed. In the first sequence of the front surface printing, operation in each of the units from the sheet feeding unit 1 to the inspecting unit 5 is the same as the above-described operation of the single-sided printing. In the cutter unit 6, the cutting operation is not performed, and the continuous sheet is conveyed to the drying unit 8 as is. After inks on the front surface have been dried in the drying unit 8, the sheet is introduced not to a path toward the discharge conveyance unit 10 but to a path toward the sheet rewinding unit 9. The introduced sheet is rewound by the rewinding drum of the sheet rewinding unit 9, which rotates in a forward direction (in the diagram, in an anticlockwise direction). After intended front surface printing has been wholly completed in the printing unit 4, a rear end of a print area of the continuous sheet is cut in the cutter unit 6. With reference to a position of the cutting, the continuous sheet on a conveying direction downstream side (on a printed side) passes through the drying unit 8 and is then wholly rewound to the sheet rear end (cutting position) at the sheet rewinding unit 9. On the other hand, the continuous sheet on a conveying direction upstream side of the cutting position is wound back by the sheet feeding unit 1 so as to prevent a sheet fore end (cutting position) from remaining in the decurling unit 2.

After the above front surface printing sequence, the sequence is switched to the back surface printing sequence. The rewinding drum of the sheet rewinding unit 9 rotates in a reverse direction (in the diagram, in a clockwise direction) to the direction at the time of the rewinding. The end part of the rewound sheet (the sheet rear end at the time of the rewinding serves as a sheet fore end at the time of sending) is sent to the decurling unit 2. In the decurling unit 2, reverse curl corrections to the previous curl corrections are made. This is because the sheet wound by the rewinding drum is wound with being turned over as compared with the roll in the sheet feeding unit 1, and has therefore reverse curl. After that, the continuous sheet passes through the skewing correcting unit 3, and printed on the back surface thereof in the printing unit 4. The printed sheet passes through the inspecting unit 5, and is then cut in the cutter unit 6 at intervals of a predetermined unit length that is preset. The cut sheets are printed on both of the surfaces, and therefore printing in the information printing unit 7 is not performed. The cut sheets are conveyed to the drying unit 8 one by one, and through the discharge conveyance unit 10, sequentially discharged to and stacked on the tray 12 of the sorter unit 11.

Also, the printing apparatus 100 of the present embodiment has a sheet drying device (hereinafter also referred to as the drying unit or a drying mechanism) for drying a printed sheet. The drying unit 8 circulates an air current along a printed sheet to dry the printed sheet while conveying the sheet. In the following, the drying unit 8 in the printing apparatus 100 is described in more detail.

Figure 6:
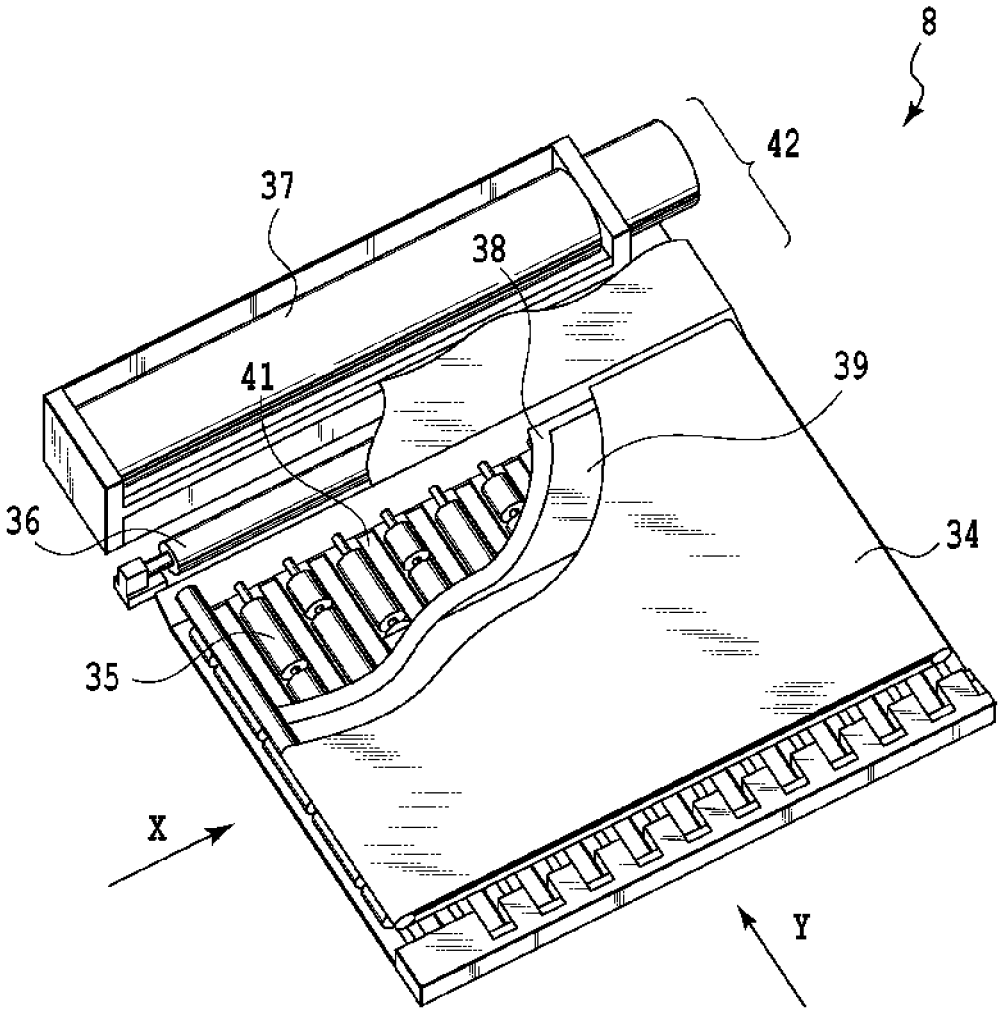
FIG. 6 is a perspective view illustrating a configuration of a drying unit used in the printing apparatus in FIG. 1 with part of the drying unit being fractured.

FIG. 6 illustrates a schematic configuration of the drying unit 8. FIG. 6 is a schematic perspective view illustrating the schematic configuration of the drying unit 8 with part of the drying unit 8 being fractured.

The sheet 40 conveyed from the cutter unit 6 to the drying unit 8 is conveyed along the conveyance path in the drying unit by the conveying belt 34 driven by an unillustrated driving motor and the conveying rollers 35 facing to the conveying belt 34. In the present embodiment, the conveying rollers 35 are positioned below the sheet, and the sheet 40 is supported by the conveying roller 35. That is, in the present embodiment, the conveying rollers (rollers) 35 function as support units configured to support the sheet. The plurality of conveying rollers 35 are arranged inside the drying unit 8 along the conveying direction of the sheet 40. In the present embodiment, the conveying rollers 35 come into abutting contact with the sheet 40 when the sheet 40 is conveyed, and is driven by the conveyance of the sheet 40 to rotate. The conveying belt 34 is driven to move in the conveying direction along the conveyance path between driving shafts, and thereby the sheet 40 is conveyed in a state of being arranged with being placed between the conveying belt 34 and the conveying rollers 35. Accordingly, in the present embodiment, the conveying belt 34 functions as a conveyance unit configured to convey the sheet 40 on the conveyance path along the conveying direction. After drying the sheet 40 has been completed, the sheet 40 is conveyed to the discharge conveyance unit 10 in the case where the sheet 40 is a cut sheet, whereas in the case where the sheet 40 is a continuous sheet, the sheet 40 is conveyed to the sheet rewinding unit 9.

Also, the drying unit 8 is provided with a hot air device 42 that blows hot air for drying inks ejected onto the sheet 40. The hot air device 42 is provided with: a heater 36 for heating air; and a fan 37 (blower unit) for blowing the heated air, i.e., hot air on a printed surface of the sheet 40. As described, the drying unit 8 has the fan 37 that provides kinetic energy to air (gas) inside the drying unit 8 to generate the air current. In the present embodiment, as illustrated in FIG. 6, lateral to the conveyance path for the sheet 40, the hot air device 42 that has substantially the same length as that of the drying unit 8 in a direction parallel to the direction in which the conveyance path extends is provided. The hot air device 42 blows the hot air from a lateral side of the conveyance path toward a direction intersecting with the conveyance path. Based on this, the drying unit 8 is configured such that the sheet 40 in which the inks are placed on the lower surface is dried by the hot air blown through nozzles 41. Thus, the drying unit 8 can dry the sheet by circulating the air current toward the printed sheet.

Figure 9:
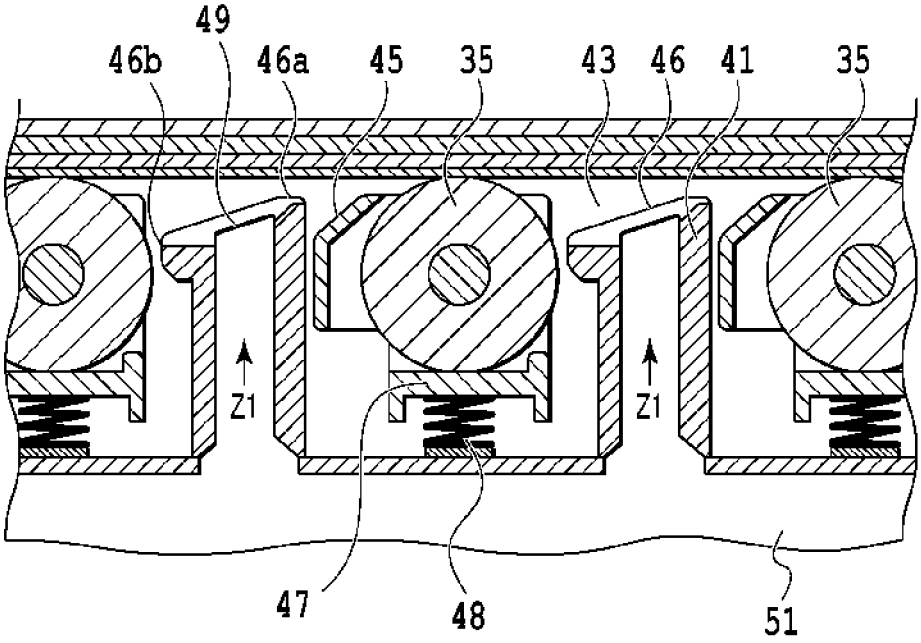
FIG. 9 is a schematic cross-sectional view illustrating enlarged conveying rollers and periphery of nozzles in the drying unit in FIG. 6.

The drying unit 8 has the nozzles 41 (blowout units) each of which changes a direction of the air current blown from the fan 37 and blows out the air current from a blowout port 49 (a top end portion of the nozzle) opened toward the printed surface (one surface) of the sheet 40. As described, at one end part of each of the nozzles 41, the blowout port 49 is opened (FIG. 9). The nozzles 41 are arranged between the plurality of conveying rollers in the conveying direction of the sheet 40 along the conveyance path. Each of the blowout ports 49 is tilted with respect to a blowout direction of the air current blowing toward the printed surface of the sheet 40 so as to face to an upstream side of the conveying direction of the sheet 40.

Around each of the hot air blowout ports 49 of the nozzles 41, a bridge member 46 is arranged so as to prevent a sheet end part from falling down to the nozzle opening part. As described, at the end part formed with the blowout port 49 in the nozzle 41, the bridge member (abutting contact part) 46 allowing abutting contact with the sheet 40 is formed. At the end part of the nozzle 41, the bridge member 46 is formed, and therefore the end part of the sheet 40 can be prevented from being caught on the nozzle 41 due to the generation of curl or the like of the sheet 40 at the time when the sheet 40 is conveyed inside the drying unit 8. Even if the fore end part of the sheet travels toward the nozzle 41 due to the generation of curl of the sheet 40, the bridge member 46 allowing the abutting contact with the sheet 40 is formed at the end part of the nozzle 41, and therefore the end part of the sheet 40 is pushed back to the conveyance path again. At this time, the blowout port 49 of the nozzle 41 is tilted so as to face to the upstream side, so that the end part of the sheet 40 is smoothly pushed back to the conveyance path, and therefore the sheet 40 can be prevented from being jammed when the sheet 40 is conveyed.

Each of the nozzles 41 is formed in a slit shape in which the blowout port 49 extends in the sheet width direction intersecting with the conveying direction. In particular, in the present embodiment, the slit-like blowout port 49 of each of the nozzles 41 extends in the direction orthogonal to the conveying direction.

Also, on an inner circumference of the conveying belt 34, a heat transfer plate 38 and a flat heating element 39 are provided. The flat heating element 39 can control temperature of each of regions defined by division in the width direction of the sheet 40. The heat transfer plate 38 can make an adjustment to any setting temperature on the basis of the heating by the flat heating element 39. The conveying belt 34 moves while sliding on a surface of the heat transfer plate 38 with a back surface thereof remaining in contact with the heat transfer plate 38. Heating through the heat transfer plate 38 causes the conveying belt 34 to be heated to keep temperature even at the time of high-speed continuous printing, and thereby drying performance is kept. That is, operation and role of the drying unit 8 are to, while performing the heating and drying operation on the sheets 40 conveyed from the cutter unit 6, sequentially send the sheets 40 with the conveying belt 34 and conveying rollers 35 to guide the sheets 40 from a drying unit discharge part toward the outside of the drying unit 8.

Figure 7:
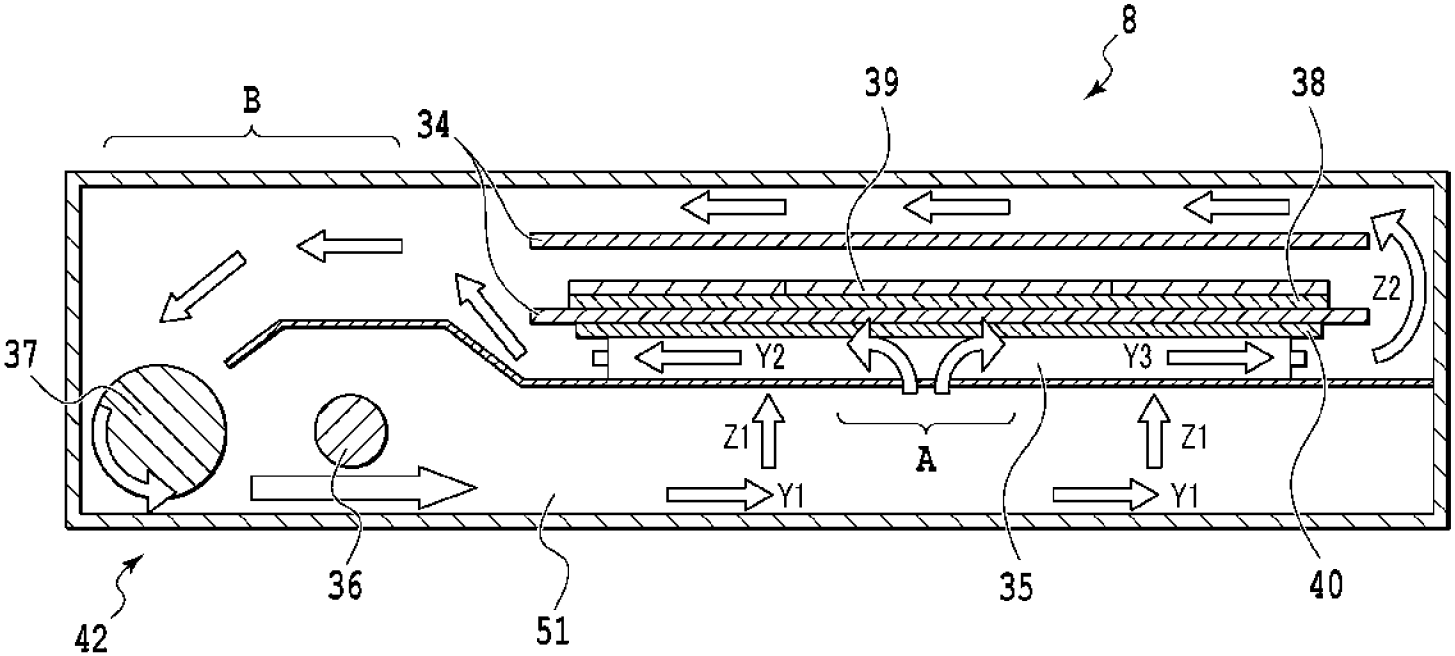
FIG. 7 is a cross-sectional view schematically illustrating an internal configuration of the drying unit in FIG. 6 with viewing the internal configuration from a front side in a sheet conveying direction.
Figure 8:
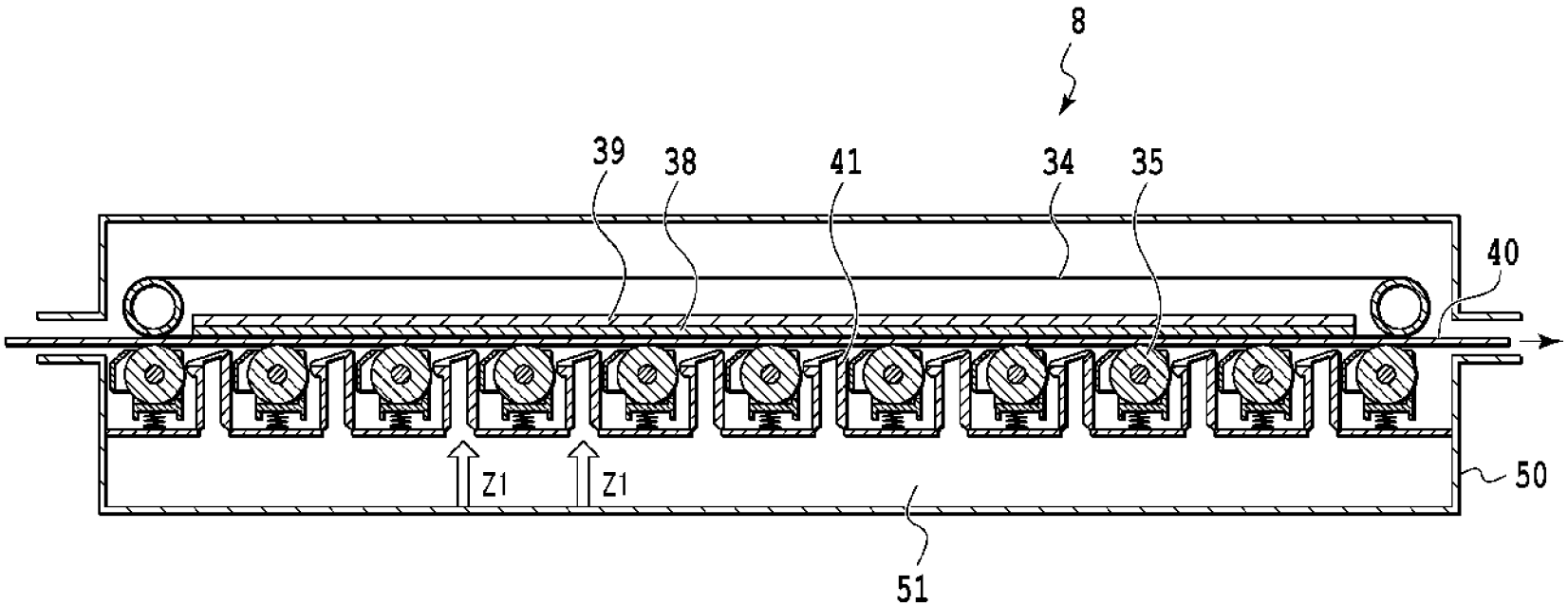
FIG. 8 is a cross-sectional view schematically illustrating the internal configuration of the drying unit in FIG. 6 with viewing the internal configuration from a side in the sheet conveying direction.

Next, FIGS. 7, 8, and 9 are used to describe a circulation path for the hot air. FIG. 7 is a cross-sectional view schematically illustrating the drying unit 8 in FIG. 6 with viewing the drying unit 8 in a direction indicated by an arrow X. Also, FIG. 8 is a cross-sectional view schematically illustrating the drying unit 8 in FIG. 6 with viewing the drying unit 8 in a direction indicated by an arrow Y. FIG. 9 is a cross-sectional view illustrating an enlarged portion around the conveying belt 34 and conveying rollers 35 of the drying unit 8 in FIG. 8.

As illustrated in FIG. 7, at the time of drying the sheet 40 with the drying unit 8, first, the air current generated by the fan 37 is heated by the heater 36 to become the hot air, and the hot air flows along a bottom surface of a housing of the drying unit 8 and is blown in a direction indicated by an arrow Y1. The hot air flowing along the bottom surface of the drying unit 8 is changed in flow direction from the bottom surface by each of the nozzles 41, and travels in a direction indicated by an arrow Z1 from there. The air current changed in direction toward the direction indicated by the arrow Z1 by the nozzle 41 is directly supplied toward the printed surface of the sheet 40, and flows along the printed surface of the sheet 40 from there. At this time, the hot air having passed through the nozzle 41 is dispersed along the sheet 40.

Part of the hot air, which travels toward an upstream side, travels in a direction indicated by an arrow Y2 after having passed through the nozzle 41, and travels toward a negative pressure region B formed by driving of the fan 37. The air current traveling in the direction indicated by the arrow Y2 after the blowout toward the sheet 40 returns to the fan 37 and circulates again. On the other hand, hot air flowing toward a downstream side after the blowout from the nozzle 41 travels in a direction indicated by an arrow Y3; then once travels in a direction indicated by an arrow Z2; and from there, flows above the conveying belt 34. After the hot air flowing above the conveying belt 34 has passed through a region along the conveying belt 34, the hot air travels toward the negative pressure region B, and returns to the fan 37 similarly to the hot air traveling from the nozzle 41 toward the upstream side. That is, a path of the hot air having passed through the nozzle 41 is divided into the paths indicated by the arrows Y2 and Y3.

When the hot air circulates along the sheet 40, the hot air takes, from the sheet 40, moisture contained in the inks impacted at the time of the printing, and thereby dries the sheet 40. Also, heat of the hot air is transferred to the sheet 40, and thereby the sheet 40 is heated, which enables the sheet 40 to be further dried. When the hot air flows along the sheet 40, the sheet 40 is dried, and therefore a printed image printed on the sheet 40 can be quickly and surely fixed. As described, the fixation of the ink droplets to the sheet 40 can be quickly performed, and therefore quality of the printed image can be prevented from being reduced by the contact of the printed surface of the sheet 40 with a surround before the printed image on the sheet 40 is dried. Also, the inks can be prevented from being attached to the surround to make the surround dirty with the attached inks by the contact of the sheet 40 with the surround before the printed image is dried.

In this case, the hot air having passed through each of the nozzles 41 flows in the directions indicated by the arrows Y2 and Y3, and then passes through a hot air passing region 43 in FIG. 9. If the hot air passing region 43 is narrowly formed, the hot air cannot smoothly pass through the hot air passing region 43. For this reason, the hot air does not smoothly circulate, and highly humid air generated by the drying operation remains near the sheet, which in turn may cause efficiency of the drying operation to be reduced.

Accordingly, it is conceived that the end part of each of the nozzles 41 on a side adjacent to the sheet 40 is separated from the sheet 40 largely to enlarge the hot air passing region 43 in a Z direction, and thereby ensure a space for the hot air to pass through to reduce resistance to hot air flow. This enables the hot air to smoothly flow in the hot air passing region 43 to efficiently dry the sheet 40.

However, each of the nozzles 41 also has a guide function to convey the sheet 40, which prevents the sheet 40 from falling into a space between the conveying rollers 35. For this reason, in the case where the end part of the nozzle 41 is separated from the sheet 40 to increase a distance between the end part of the nozzle 41 and the sheet 40, if the end part of the sheet 40 falls into the space between the conveying rollers 35, posture of the sheet 40 cannot be corrected. For this reason, a means adapted to enlarge the hot air passing region 43 in the Z direction to smooth the passage of the hot air is not preferable.

Therefore, in the present embodiment, as illustrated in FIG. 9, the blowout ports 49 of the nozzles 41 are tilted so as to face to the upstream side. That is, the blowout ports 49 are tilted in a direction that causes the upstream side in the sheet conveying direction to be more separated from the sheet than the downstream side. Further, along with this, the bridge members 46 are also respectively provided with tilts in the same manner. As described, each of the nozzles 41 is tilted, and therefore without setting large distance between the nozzle 41 and the sheet 40, the space for the hot air to pass through can be ensured between the nozzle 41 and the sheet 40. The hot air can smoothly pass between the nozzle 41 and the sheet 40, and therefore the sheet 40 can be efficiently dried. In the present embodiment, a position of a bridge member upper most point 46*a* of each of the bridge members 46, which functions as a guide to a roller nip that nips the sheets 40 between the conveying belt 34 and a corresponding one of the conveying rollers 35, is set to a position approximately 2 mm distant from the conveying belt 34.

Also, in the present embodiment, the blowout port 49 of each of the nozzles 41 is tilted so as to face to the upstream side, and therefore a position of a bridge member lowermost point 46*b* that plays a role of scooping the fore end of the sheet 40 is set to a position approximately 6 mm distant from the belt. During the conveyance of the sheet 40, when the fore end part of the sheet 40 passes through the region between each of the nozzles 41 and the conveying belt 34, if the fore end part of the sheet 40 bends downward, the fore end part of the sheet 40 is scooped by the tilted bridge member 46 of the nozzle 41 to correct the posture. For this reason, conveyance stability of the sheet 40 can be improved. Also, the blowout port 49 of each of the nozzles 41 is tilted as described, and therefore the hot air smoothly circulates. Further, the hot air smoothly circulates inside the drying unit 8, so that the hot air is prevented from locally remaining, and thereby the drying can be uniformly performed in the width direction of the sheet 40. The drying is uniformly performed in the width direction of the sheet 40, so that at the time of drying a printed image, drying speed can be prevented from being different depending on a position, and therefore color unevenness (drying unevenness) can be prevented from occurring in the printed image.

Also, each of the conveying rollers 35 is held by a roller holding body 47, and the roller holding body 47 is connected to the housing 50 of the drying unit 8 through an elastic body 48 such as a spring. Further, the roller holding body 47 is biased by action of the elastic body 48 in a direction in which the roller holding body 47 presses the sheet 40 against the conveying belt 34, and a pressing state against the sheet 40 by the elastic body 48 is kept. Note that, in the present embodiment, the roller holding body 47 holding the conveying roller 35 is biased by the elastic body 48; however, the present invention is not limited to this, and the roller holding body 47 may be biased by another elastic member. This enables nip pressure on the sheet 40 by the conveying roller 35 to be kept.

Also, the roller holding body 47 is provided with a guide surface 45 that guides the fore end of the introduced sheet to the conveyance path so as to prevent the fore end from falling down before a corresponding one of the conveying rollers. When the fore end of the sheet 40 comes into abutting contact with a corresponding one of the bridge members 46 due to the generation of deformation such as curl in the sheet 40, the fore end of the sheet 40, which is scooped by the bridge member 46, is guided to the conveyance path by the guide surface 45. As described, the roller holding body 47 delivers the fore end of the sheet 40 sent from the bridge member 46 of a corresponding one of nozzles 41.

As described above, the conveying roller 35 and the roller holding body 47 are formed variably in position in the Z1 direction depending on a thickness of the sheet. In the present embodiment, even if the conveying roller 35 moves upward to the utmost extent, a height of a fore end part in the guide surface 45 is set not to be higher than the bridge member uppermost point 46*a*. That is, even when the conveying roller 35 is at a position most separated from the sheet 40, a closest position to the sheet 40 in the guide surface 45 is arranged at a position more separated from the sheet 40 than the bridge member uppermost point 46*a* of the bridge member 46, which is closest to the sheet 40. A position in the guide surface 45, which is most separated from the conveying belt 34 with respect to the hot air blowout direction, is more separated from the conveying belt 34 than a position in the bridge member 46 of the nozzle 41, which is closest to the conveying belt 34. As a result, effects of more smoothly delivering the sheet 40 from the guide surface 45 to the nozzle 41, and also improving the conveyance stability at the time of conveying the sheet can be obtained.

Figure 10:
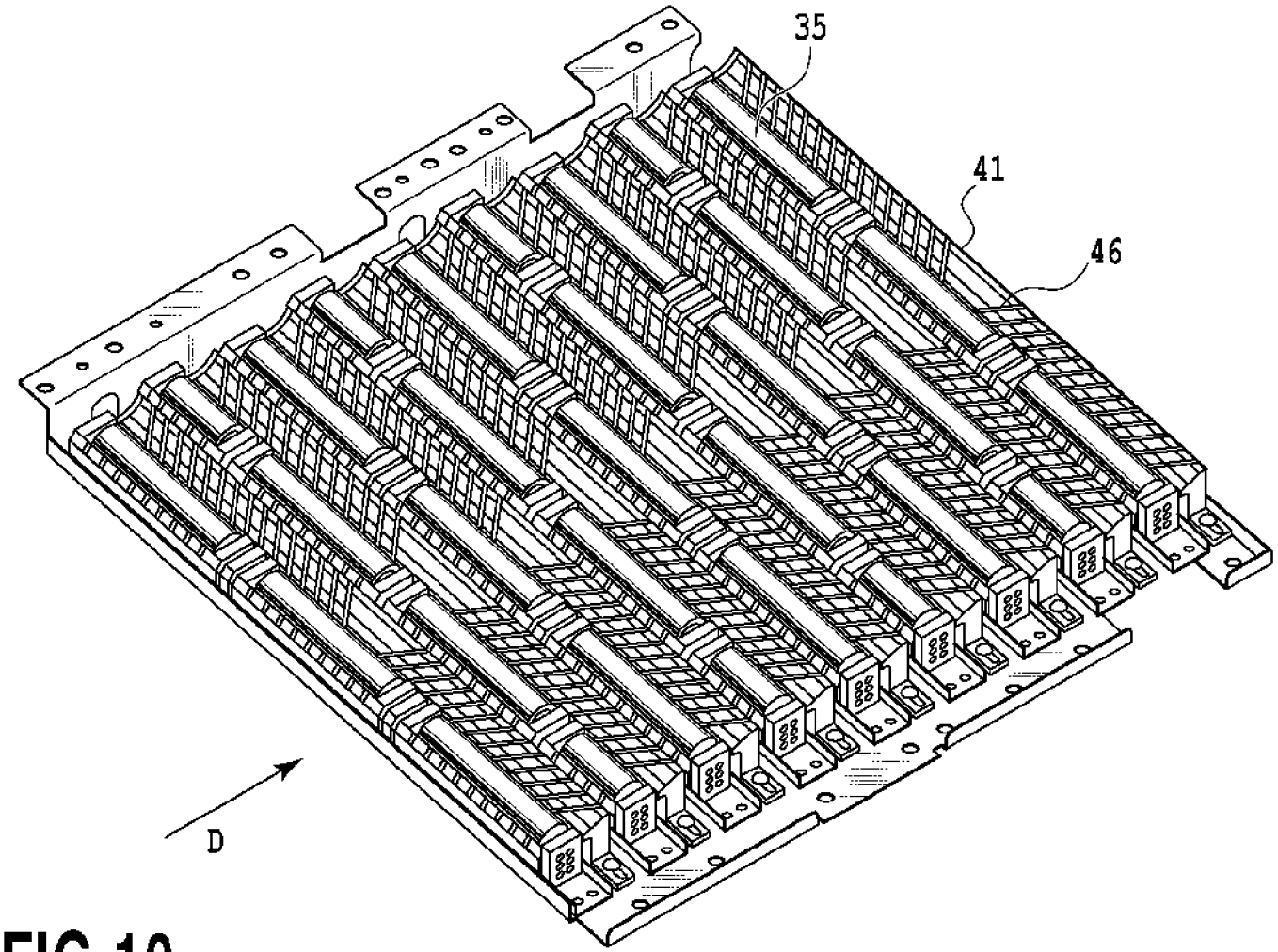
FIG. 10 is a perspective view illustrating the conveying rollers and nozzles of the drying unit in FIG. 6.

Each of the bridge members 46 may be, as illustrated in FIG. 10, arranged with being tilted with respect to the conveying direction D of the sheet 40 such that a front side in the conveying direction is broadened as planarly viewed from above. As described, by arranging the bridge member 46 with tilting the bridge member 46 with respect to the sheet conveying direction D, even if the end part of the sheet 40 falls from the blowout port 49 of a corresponding one of the nozzles 41, the fore end part of the sheet 40 is scooped by further performing the conveyance from there. When the sheet 40 deviates from the conveyance path to come into abutting contact with the bridge member 46, such an action of scooping the sheet 40 can be utilized, and therefore an effect of further improving the conveyance stability of the sheet 40 can be obtained at the time of conveying the sheet.

According to the drying unit 8 of the present embodiment, the sheet 40 is supported by the plurality of conveying rollers 35, so that the sheet 40 is not required to be supported by an air current, and therefore it is not necessary to blow an air current enough to support the sheet with overcoming weight of the sheet. Accordingly, a flow rate of the air current can be limited to a flow rate necessary to dry the sheet 40, and therefore kept small. For this reason, it is not necessary to largely ensure a flow path space of a duct 51 through which the air current passes before passing through the nozzles 41, and therefore the drying unit 8 can be downsized. Also, in the present embodiment, the blowout ports 49 of the nozzles 41 are tilted so as to face to the upstream side, and therefore flow paths of air currents blown from the nozzles 41 are ensured. As a result, the space for the flow paths of the air currents between the nozzles 41 and the sheet 40 is ensured with the distance between the nozzles 41 and the sheet 40 remaining short. As described, the distance between the nozzles 41 and the sheet 40 is shortened with the flow paths of the air currents between the nozzles 41 and the sheet 40 being ensured, and therefore the drying unit 8 can be downsized. Also, the drying unit 8 is downsized, and therefore manufacturing cost of the printing apparatus 100 can be kept low. Further, the drying unit 8 can be downsized, and also when the end part of the sheet 40 deviates in position from the conveyance path, the deviation can be corrected. For this reason, the sheet 40 can be stably conveyed with the drying unit 8 being downsized. In the above embodiment, described is a configuration in which the conveying belt 34 functions as the conveyance unit configured to be driven to convey the sheet, and the conveying rollers 35 function as the support units configured to support the sheet. However, the present invention is not limited to this, but may be configured such that the sheet is, in a state of being placed between a roller that performs rotational driving and a roller that performs driven rotation along with the rotational driving of the roller, conveyed by the rotational driving by the roller performing the rotational driving. In such a case, the roller performing the rotational driving functions as the conveyance unit, and the roller performing the driven rotation functions as the support unit. Also, a combination of the sheet conveyance unit and the sheet support unit may be another combination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-231637, filed Oct. 21, 2011, which is hereby incorporated by reference herein in its entirety.

What is claimed is:

1. A printing apparatus comprising:

a print head of an inkjet type; and a drying device that dries a sheet printed by the print head, wherein the drying device includes:

a plurality of rollers configured to support the sheet;

a conveyance unit having a belt configured to convey the sheet, wherein each of the rollers is biased toward the belt by an elastic part, and the sheet is conveyed while placed between the rollers and the belt; and a blowout unit that is arranged between the plurality of rollers in a direction of the conveyance of the sheet by the conveyance unit and configured to blow gas toward the sheet, wherein the blowout unit includes a blowout port that is tilted with respect to a surface of the sheet being supported by the rollers.

2. The printing apparatus according to claim 1, wherein the blowout port is tilted in a direction that causes an upstream side in the conveying direction to be more separated from the sheet than a downstream side.

3. The printing apparatus according to claim 2, wherein an abutting contact part that allows abutting contact with the sheet is formed at an end part of the tilted blowout port.

4. The printing apparatus according to claim 1, wherein the blowout port is formed in a slit shape that extends in a sheet width direction intersecting with the conveying direction.

5. The printing apparatus according to claim 1, wherein each of the rollers is held by a holding body; a corresponding one of the elastic bodies biases each holding body; and a tilted guide surface guides a fore end of the sheet to be introduced so as to prevent the fore end from falling down before a position of one of the rollers.

6. The printing apparatus according to claim 5, wherein an abutting contact part that allows abutting contact with the sheet is formed at an end part of the tilted blowout port; and a most separated position from the sheet of the tilted guide surface is more separated from the sheet than a closest position to the sheet of the abutting contact part.

7. A sheet drying device for drying a sheet comprising:

a plurality of rollers configured to support the sheet;

a conveyance unit having a belt configured to convey the sheet, wherein each of the rollers is biased toward the belt by an elastic part, and the sheet is conveyed while placed between the rollers and the belt; and a blowout unit that is arranged between the plurality of rollers in a direction of the conveyance of the sheet by the conveyance unit and configured to blow gas toward the sheet, wherein the blowout unit includes a blowout port that is tilted with respect to a surface of the sheet being supported by the rollers.

8. The sheet drying device according to claim 7, wherein the blowout port is tilted in a direction that causes an upstream side in the conveying direction to be more separated from the sheet than a downstream side.

9. The sheet drying device according to claim 8, wherein an abutting contact part that allows abutting contact with the sheet is formed at an end part of the tilted blowout port.

10. The sheet drying device according to claim 7, wherein the blowout port is formed in a slit shape that extends in a sheet width direction intersecting with the conveying direction.

* * * * *